US005167541A

United States Patent [19]

Alves et al.

[11] Patent Number: 5,167,541

[45] Date of Patent: Dec. 1, 1992

[54] FUSE HOLDER APPARATUS WITH FLEXIBLE DETENTING

[75] Inventors: Roger J. Alves, Simi Valley; Roy Nimpoeno, Northridge, both of Calif.

[73] Assignee: Scosche Industries, Inc., Moorpark, Calif.

[21] Appl. No.: 796,271

[22] Filed: Nov. 27, 1991

[51] Int. Cl.[5] ..... H01R 13/68

[52] U.S. Cl. ..... 439/622; 337/186

[58] Field of Search ..... 439/621, 622; 337/186, 337/194, 195

*Primary Examiner*—Gary F. Paumen

*Attorney, Agent, or Firm*—William W. Haefliger

[57] ABSTRACT

Fuse holder apparatus comprising, in combination a base; fuse carrying means on the base, including a first fuse end receiver to receive one end of the fuse, and a second fuse end receiver to receive the other end of the fuse, the second receiver being movable toward and away from the first receiver; and a displaceable ratchet carried on the base to hold the second receiver in an advanced position in which the fuse ends are received by the receivers, and to enable release of the fuse, for replacement, in response to displacement of the ratchet in conjunction with retraction of the second receiver away from the first receiver.

16 Claims, 2 Drawing Sheets

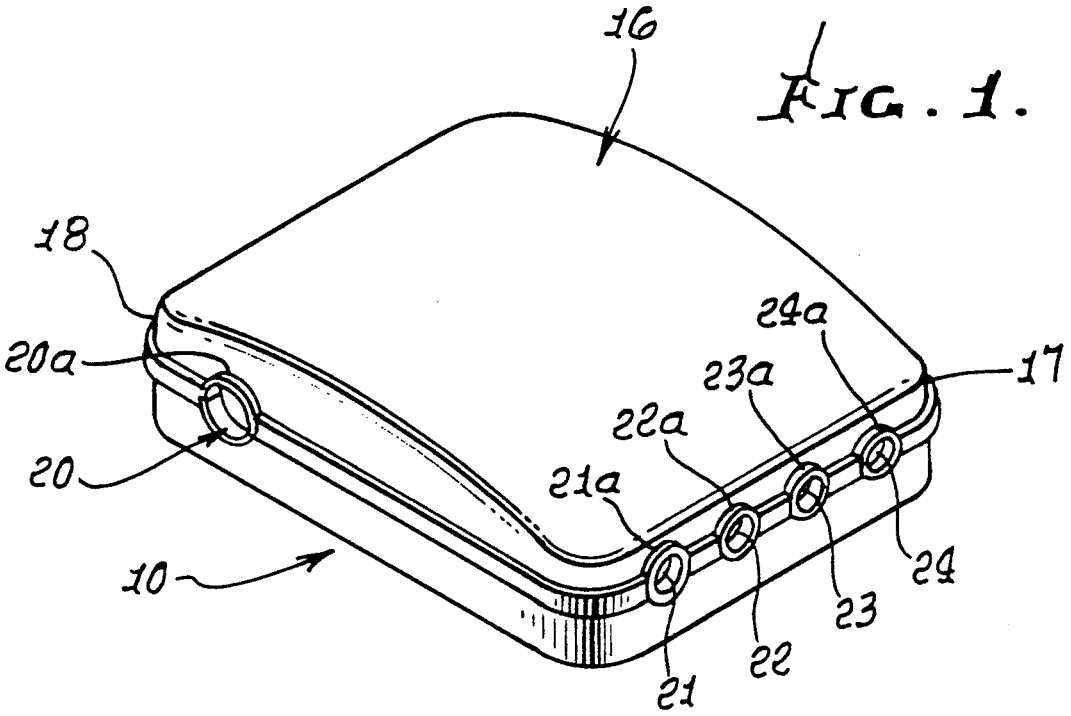
FIG. 1.
FIG. 2.
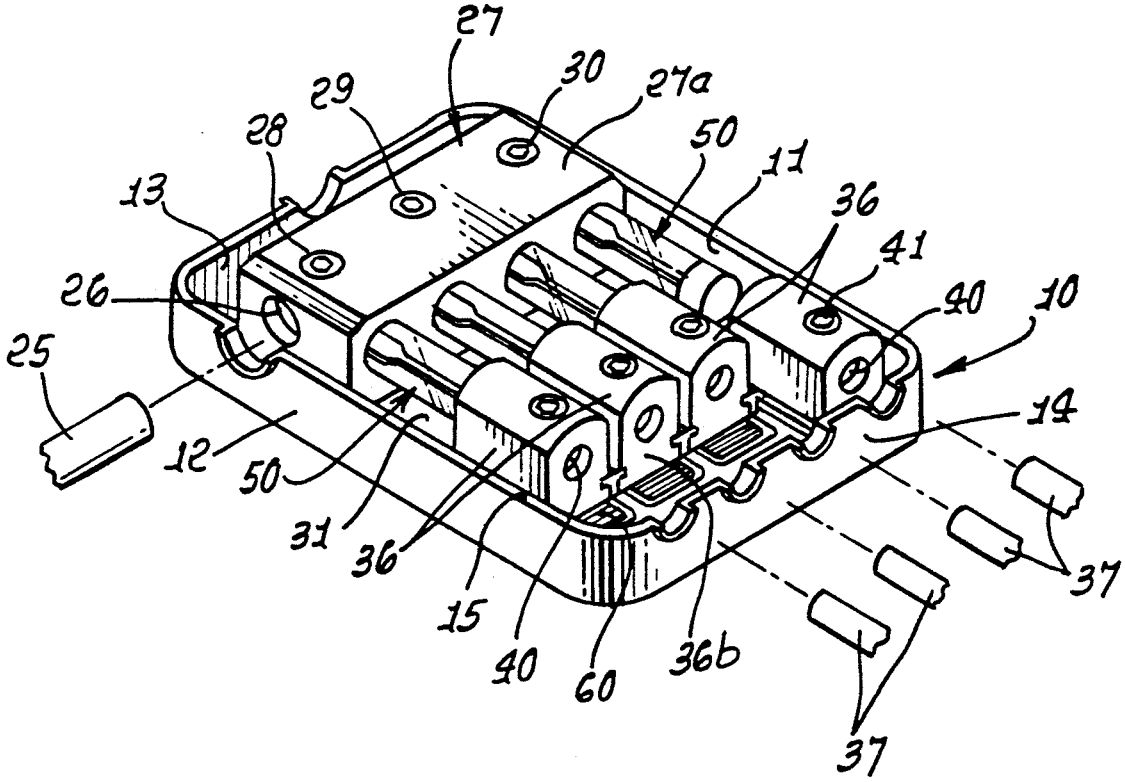

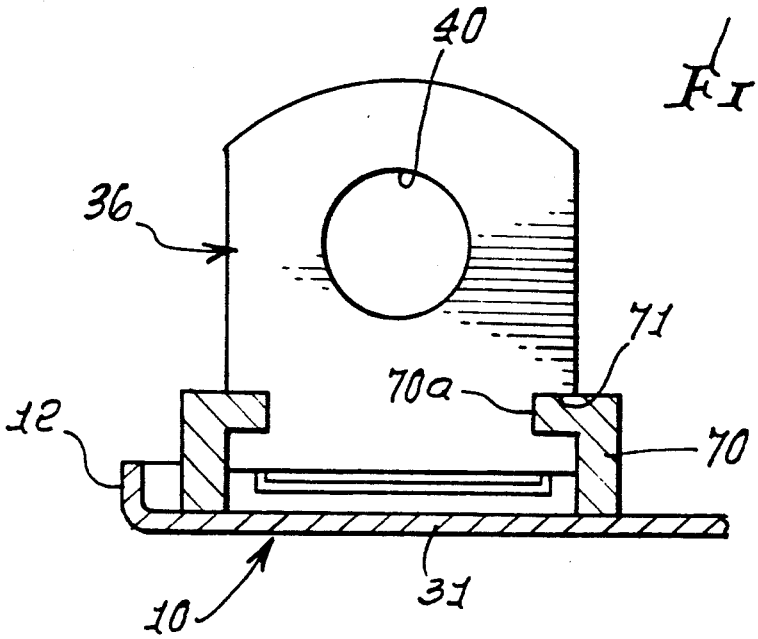
FIG. 4.
FIG. 3.
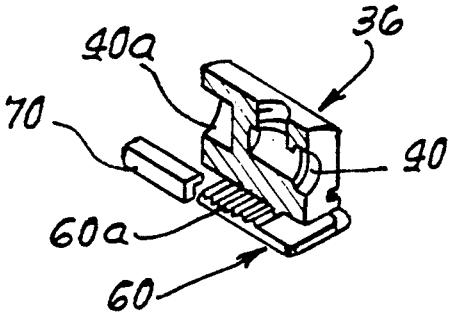
FIG. 5.
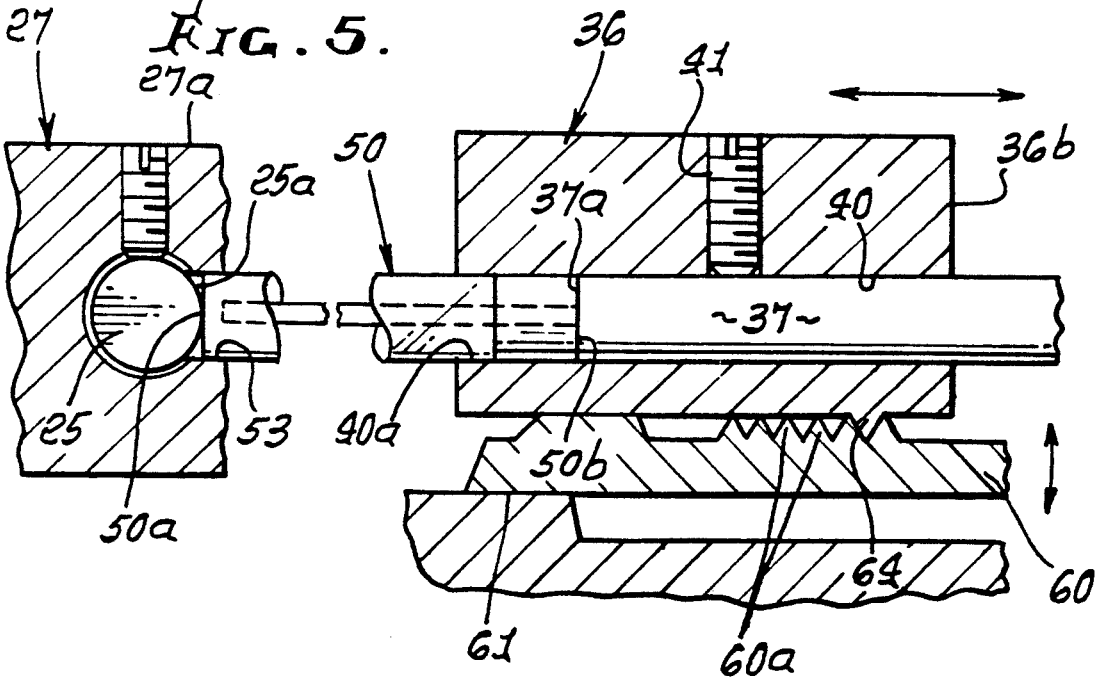

FUSE HOLDER APPARATUS WITH FLEXIBLE DETENTING

BACKGROUND OF THE INVENTION

This invention relates generally to the mounting of fuses, to facilitate their replacement, and more particularly concerns a single efficient fuse holder apparatus wherein retention of a fuse or fuses in secure positions is assured, while enabling quick replacement of the fuses, as required.

There is continued need for apparatus that mounts electrical fuses in a secure manner, yet enables their ready replacement. No prior apparatus of which we are aware embodies the unusual advantages in construction, mode of operation and results achieved by the apparatus of the present invention, which meets the above need.

SUMMARY OF THE INVENTION

It is a major object of the invention to provide apparatus meeting the described need. Basically, such apparatus comprises, in combination:

a) a base, b) fuse carrying means on the base, including a first fuse end receiver to receive one end of the fuse, and a second fuse end receiver to receive the other end of the fuse, the second receiver being movable toward and away from the first receiver, c) and a displaceable ratchet carried on the base to hold the second receiver in an advanced position in which the fuse ends are received by the receivers, and to enable release of the fuse, for replacement, in response to displacement of the ratchet in conjunction with retraction of the second receiver away from the first receiver.

As will be seen, connector means is typically provided on the receivers to enable connection to electrical cables for electrical connection via said fuse positioned between the receivers.

It is another object of the invention to provide the displaceable ratchet with a resiliently flexible strip having cantilever mounting on the base. In this regard, the second fuse end receiver may also carry or support ratchet engaging structure engageable with said displaceable ratchet. The flexible strip referred to may advantageously extend directionally lengthwise relatively away from the first fuse end receiver, and may be displaceable away from said second fuse end receiver, generally normal to said lengthwise direction.

Yet another object of the invention is to provide guide means on the base to guide movement of the second receiver toward and away from the first receiver, and along a predetermined path, such guide means extending longitudinally lengthwise; and the receiver may have recess means opening in longitudinal directions to receive opposite ends of the fuse. Guide means for cables connected to the second fuse end receivers is also provided.

Additional advantages include the provision of a tray receiving the base, the fuse carrying means extending upwardly, on said tray, and including a tray cover extending over the fuse carrying means and said base; the first fuse end receiver comprising a first body having multiple recesses to receive first ends of multiple like fuses extending in parallel longitudinally elongated relation; and the second fuse end receiver including multiple second bodies having recesses therein to receive second ends of said multiple fuses, there being multiple of said ratchets extending in longitudinally elongated parallel relation, the second bodies being individually movable longitudinally over said ratchets, respectively, to allow fuse replacement, and fuse end engagement with electrical contact means in said bodies.

These and other objects and advantages of the invention, as well as the details of an illustrative embodiment, will be more fully understood from the following specification and drawings, in which:

DRAWING DESCRIPTION

FIG. 1 is a perspective view of apparatus incorporating the invention, a tray cover fitted over a tray;

FIG. 2 is a view like FIG. 1, but showing the tray and its fuse and fuse receiver structure, the cover being removed;

FIG. 3 is a perspective view of a movable fuse receiver, shown in section;

FIG. 4 is an enlarged vertical section showing guiding of the movable fuse receiver, and the positioning of ratchet means acting on the receiver; and FIG. 5 is an enlarged vertical section taken lengthwise of the ratchet means and showing its interengagement with the movable fuse holder.

DETAILED DESCRIPTION

In the drawings, a tray 10 has upstanding side walls 11 and 12, and end walls 13 and 14, such walls defining an upward facing looping rim 15. A cover 16 fits down over the tray and has downwardly extending side walls and end walls 17 and 18, that engage the rim 15. Such mating side and end walls of the receptacle and cover define a side opening 20 and end openings 21–24, as shown, with co-operating protruding flanges **20*a* and 21*a*–24*a* about the openings to seat cables. A side cable 25 is laterally accessible through side opening 20, for reception into a side opening 26 in a first fuse end receiver block 27, to be clamped by laterally spaced set screws 28–30 that are downwardly threadable into that block 27, from its top surface 27*a*. Good electrical contact is thereby made between cable 25 and block 27, both consisting of electrically conductive material, one example being aluminum or copper. The tray has a bottom wall 31 that may define, or support, a base underlying block 27**, and to which the latter may be suitably attached, whereby the block is fixedly retained in the tray. The tray and cover may consist of electrically insulative plastic material.

Also retained in the receptacle is a second fuse end receiver 36, or a set of such receivers 36, spaced laterally side by side, in longitudinally offset relation to block 27. Receivers 36 are alike and are longitudinally elongated, as shown. An end cable 37, or cables 37, are longitudinally receivable through an opening or openings 21–24, for parallel reception into end openings 40 in the fuse receiver blocks 36. Set screws 41 are downwardly threadable into the blocks or receivers 36, from their top surfaces, to clamp the inserted ends of the cables received in openings 40. The cables 37 are then held in parallel relation between blocks 36 and end openings 21 and 24, in which the cables may slidably interfit as the receivers 36 are moved longitudinally back and forth, as will be explained. Accordingly, connector means are provided on receivers 27 and 36 to enable connection to electrical cables, for electrical connection to a fuse or fuses to be retained between 27 and 36.

FIGS. 2 and 5 show parallel, elongated, generally tubular fuses 50, retained by and between the retainer blocks 27 and 36, blocks 36 being individually adjustably movable endwise to assure electrical contact engagement of the ends 50*a* and 50*b* of the fuses with the side 25*a* of the cable 25, and with ends 37*a* of cables 37 in receivers 36. This facilitates individual longitudinal retraction of the blocks 36 for selectively individual fuse replacement, while also accommodating individual advancement of the blocks 36 to assure good electrical contact of each of the fuses with the cable 25 and cables 37. See in this regard, openings or recesses 53 and 40*a* in the respective blocks 27 and 36, for reception of the fuse opposite ends.

To further accommodate back and forth longitudinal movement of the receiver blocks or bodies 36, and retention of such bodies in selected positions relative to the fuses and cables, and to accommodate for different sizes and positions of the cables and fuses, a displaceable ratchet is carried on the base to hold the second receiver in an advanced position in which the fuse ends are received by the receivers 27 and 36, and to enable release of the fuse, for replacement, in response to downward displacement of the ratchet in conjunction with retraction of the second receiver away from the first receiver. See for example, the plastic strip or strips 60 in FIGS. 3 and 5 attached to the base at 61, and projecting in cantilever relation, longitudinally relatively away from the receiver body 27. The ratchet teeth 60*a* on the strip project in a row, and upwardly and laterally, to engage downwardly projecting corresponding tooth or teeth 64 on the body 36. As the body 36 is retracted to the right in FIG. 5, the upper teeth 64 "ratchet" along and over the teeth 60*a*, the strip 60 being downwardly resiliently deflected as required to allow such rightward movement; however, the strip 60 remains yieldably urged upwardly to engage teeth 60*a* and 64 in any selected ultimate position of the receiver body 36. Other means to urge teeth 64 relatively toward teeth 60*a*, to provide a large number of detenting positions, may be provided. Note that a ratchet adjustment is provided for each of the receiver blocks or bodies 36, allowing their individual adjustment. Also, note in FIG. 2 that the ratchet strips project beyond the ends of the 36*b* of the bodies 36, allowing selective manual depression of the strips 60, as may be employed to ease retraction and advancement of the bodies 36.

Finally, guide means is provided on the base to guide endwise movement of the receiver bodies 36, and attached cables (as for example body retraction to permit fuse removal from 53 and 40*a*). See for example FIGS. 2–4, wherein guide rails 70 on the base project at 70*a* into elongated grooves 71 in opposite sides of each body 36. Such guide means is insulated from the first receiver 27, and may consist of insulative material. Alternatively, parts 27 and 36 may consist of insulative material.

We claim:

1. Fuse holder apparatus comprising, in combination:

a) a base, b) fuse carrying means on the base, including a first fuse end receiver to receive one end of the fuse, and a second fuse end receiver to receive the other end of the fuse, the second receiver being movable toward and away from the first receiver, c) and a displaceable ratchet carried on the base to hold the second receiver in an advanced position in which the fuse ends are received by the receivers, and to enable release of the fuse, for replacement, in response to displacement of the ratchet in conjunction with retraction of the second receiver away from the first receiver.

2. The combination of claim 1 including connector means on said receivers to enable connection to electrical cables for electrical connection via said fuse positioned between the receivers.

3. The combination of claim 1 wherein the second fuse end receiver has ratchet engaging structure engageable with said displaceable ratchet.

4. The combination of claim 3 wherein said displaceable ratchet includes a resiliently flexible strip having cantilever mounting on the base.

5. The combination of claim 4 wherein said flexible strip extends directionally lengthwise relatively away from said first fuse end receiver, and is displaceable away from said second fuse end receiver, generally normal to said lengthwise direction.

6. The combination of claim 1 including guide means on the base to guide said movement of the second receiver toward and away from the first receiver, and along a predetermined path.

7. The combination of claim 1 wherein said receivers have recess means to receive opposite ends of the fuse.

8. The combination of claim 7 including said fuse having said opposite ends thereof received in said recess means.

9. The combination of claim 8 wherein said fuse is tubular and longitudinally elongated in a direction of elongation of said displaceable ratchet.

10. The combination of claim 9 including a tray receiving said base, said fuse carrying means extending upwardly, on said tray, and including a tray cover extending over said fuse carrying means and said base.

11. The combination of claim 1 wherein said first fuse end receiver comprises a first body having multiple recesses to receive first ends of multiple like fuses extending in parallel longitudinally elongated relation.

12. The combination of claim 11 wherein the second fuse end receiver includes multiple second bodies having recesses therein to receive second ends of said multiple fuses, there being multiple of said ratchets extending in longitudinally elongated parallel relation, the second bodies being individually movable longitudinally over said ratchets, respectively, to allow fuse replacement, and fuse end engagement with electrical contact means in said bodies.

13. The combination of claim 10 wherein the tray and tray cover define a through opening, and including a cable slidable endwise in said opening, and attached to said second fuse end receiver to move therewith, away from the first receiver.

14. The combination of claim 1 including first guide means on the base to guide said movement of the second receiver in an endwise direction, and second guide means on the base to guide endwise movement, in said direction, of a cable which is attached to said second receiver.

15. The combination of claim 14 including means on the first receiver to attach a first cable thereto in position to be electrically connected to one end of the fuse, and means on the second receiver to attach a second cable thereto, in position to be electrically connected to the other end of the fuse.

16. The combination of claim 15 including insulated housing means extending about said receivers and fuse, and passing a cable to the second receiver while allowing endwise movement of that cable, relative to the housing.

* * * * *